US009074591B2

(12) United States Patent
Kita

(10) Patent No.: US 9,074,591 B2
(45) Date of Patent: Jul. 7, 2015

(54) COMPRESSOR CYLINDER BLOCK AND CYLINDER HEAD DISTORTION PREVENTION

(75) Inventor: Ichiro Kita, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 759 days.

(21) Appl. No.: 13/233,063

(22) Filed: Sep. 15, 2011

(65) Prior Publication Data

US 2012/0090461 A1 Apr. 19, 2012

(30) Foreign Application Priority Data

Oct. 14, 2010 (JP) ..... 2010-231226

(51) Int. Cl.
*F16J 10/00* (2006.01)
*F04B 39/12* (2006.01)

(52) U.S. Cl.
CPC ..... *F04B 39/125* (2013.01); *F04B 39/122* (2013.01); *F04B 39/127* (2013.01)

(58) Field of Classification Search
CPC ..... F04B 39/0215; F04B 39/0276; F04B 39/0292; F04B 39/0238; F04B 39/0246; F04B 39/0253; F04B 53/008; F04B 53/007; F04B 53/00; F04B 2201/0208; F04B 2201/0404; F04B 39/122; F04B 39/125; F04B 39/127; F16N 2200/12; F01M 1/06; F04C 15/00
USPC ..... 92/128, 157, 158, 159, 160, 162 R, 175, 92/201
See application file for complete search history.

(56) References Cited

U.S. PATENT DOCUMENTS

| | | | | |
|---|---|---|---|---|
| 2004/0052652 | A1* | 3/2004 | Yamada et al. | 417/273 |
| 2004/0057850 | A1* | 3/2004 | Nozaki et al. | 417/415 |
| 2005/0235686 | A1* | 10/2005 | Bin-Nun et al. | 62/505 |
| 2007/0256553 | A1* | 11/2007 | Lim et al. | 91/502 |
| 2010/0221129 | A1* | 9/2010 | Yanase | 417/415 |
| 2011/0027111 | A1 | 2/2011 | Inagaki et al. | |
| 2011/0154982 | A1* | 6/2011 | Ribas Junior et al. | 92/153 |
| 2011/0176942 | A1* | 7/2011 | Yagi et al. | 417/410.1 |
| 2012/0183419 | A1* | 7/2012 | Kobayashi | 417/415 |
| 2013/0230420 | A1 | 9/2013 | Inagaki et al. | |

FOREIGN PATENT DOCUMENTS

| | | | | |
|---|---|---|---|---|
| CN | 1274959 | C | 3/2006 | |
| CN | 201074550 | Y * | 6/2008 | F02F 1/00 |
| CN | 201074550 | Y | 6/2008 | |
| CN | 201306261 | Y | 9/2009 | |
| CN | 101855451 | A | 10/2010 | |
| EP | 2256344 | A1 * | 12/2010 | F04B 39/12 |

(Continued)

*Primary Examiner* — Dwayne J White
*Assistant Examiner* — Matthew Wiblin
(74) *Attorney, Agent, or Firm* — RatnerPrestia

(57) ABSTRACT

There is provided a compressor including a hermetic container storing therein a lubricant, an electric element, and a compression element driven by the electric element, the compression element including a crankshaft, a bearing portion, a cylinder block, a piston, and a joining portion, wherein a cylinder head is tightened and fixed together with a valve component by a bolt to an opening surface side of a compression chamber formed by a cylinder bore and the piston, and a screw hole portion formed in the opening surface side, for fixing the bolt includes a counterbore extending to the vicinity of a boundary between the cylindrical portion and the tapered portion.

13 Claims, 11 Drawing Sheets

(56) References Cited

FOREIGN PATENT DOCUMENTS

| | | | | | |
|---|---|---|---|---|---|
| JP | 54-077315 | A | | 6/1979 | |
| JP | 56-012079 | A | | 2/1981 | |
| JP | 63-230975 | A | | 9/1988 | |
| JP | 2002-089450 | A | | 3/2002 | |
| JP | 2002089450 | A | * | 3/2002 | ..... F04B 39/12 |
| JP | 2009-085125 | A | | 4/2009 | |
| KR | 10-2007-0030339 | A | | 3/2007 | |

* cited by examiner

COMPRESSOR CYLINDER BLOCK AND CYLINDER HEAD DISTORTION PREVENTION

BACKGROUND OF THE INVENTION

1. Field of the Invention

The present invention relates to a compressor for use in a household refrigerator or refrigerating air conditioner.

2. Description of the Related Art

This type of compressor has a cylinder, a cylinder bore formed in the cylinder, and a piston that reciprocates inside the cylinder bore to compress a gas (refrigerant or the like). For example, in Unexamined Japanese Patent Publication No. S54-77315 and Unexamined Japanese Patent Publication No. 2002-89450, there is disclosed a constitution in which in order to reduce a sliding loss between the piston and the cylinder bore, the cylinder bore is partially tapered.

Moreover, on an opening surface side of the cylinder bore in a piston compression direction, suction and exhaust are performed by a discharge valve, a suction valve, a valve plate, a cylinder head and gaskets. A series of components such as the discharge valve and the like are mounted on, and fixed to the cylinder by bolts.

Moreover, in Unexamined Japanese Patent Publication No. S56-12079 and Unexamined Japanese Patent Publication No. S63-230975, there is disclosed a constitution in which distortion of the cylinder bore is avoided in view of a fact that in the cylinder bore, the distortion is caused by tightening of the bolt.

FIG. 8 is a vertical cross-sectional view of a conventional compressor, FIG. 9 is a plan view of a substantial portion in which a part of the same compressor is cut out, and FIG. 10 is a plan view of a substantial portion in which a part of another conventional compressor disclosed in Unexamined Japanese Patent Publication No. S56-12079 is cut out.

In FIGS. 8 and 9, compressor 1 centers on cylinder block 4, and electric element 5 is arranged in a lower portion of hermetic container 2, and compression element 6 is arranged in an upper portion thereof. Compression element 6 and electric element 5 are each a part of cylinder block 4. Compression element 6 and electric element 5 are elastically supported by hermetic container 2 through suspension spring 3.

Compression element 6 is made up of piston 7, cylinder 8, suction gasket 9, valve plate 10, discharge valve gasket 11, a discharge valve and a suction valve not shown, valve seat cover 12 and the like. These are fastened by bolt 13 screwed into screw holes 8*a* provided in cylinder 8 from a valve seat cover 12 side.

Screw holes 8*a* are opened in the vicinity of cylinder bore 8*b* in which piston 7 slides. Bolts 13 are screwed into screw holes 8*a* to fasten valve seat cover 12, discharge gasket 11, valve plate 10, and suction gasket 9 to cylinder 8.

In Unexamined Japanese Patent Publication No. S56-12079 shown in FIG. 10, deformation of an inner diameter of cylinder bore 8*b* when bolts 13 are fastened is pointed out, and a constitution for a solution is described.

In FIG. 10, bolts 22 are caused to penetrate cylinder 21, suction gasket 9, valve plate 10, discharge gasket 11, valve seat cover 12 and the like in a combined state, and are then fastened with nuts 23 in screw hole portions 22*c* projected from valve seat cover 12. This allows bolt head portions 22*b* to be contained in cylinder counterbore portions 21*b*. As a result, bolts 22 do not fasten vicinities of cylinder bores 21*c*. Bolts 22 are fastened with nuts 23, thereby making distortion of cylinder bores 21*c* smaller.

Next, FIG. 11 is a cross-sectional view of a substantial portion of still another conventional compressor disclosed in Unexamined Japanese Patent Publication No. S54-77315.

In FIG. 11, a basic constitution of the compressor is the same as that of FIG. 8. Piston 52 reciprocates inside cylinder bore 51 to thereby compress a gas such as a refrigerant suctioned from suction hole 54 and exhaust the same from discharge hole 55. In FIG. 11, a discharge valve, a suction valve and the like are not shown. A space surrounded by piston 52 and cylinder bore 51 is sealed by sealing 56 of piston 52 and piston 52. Cylinder bore 51 is provided with cylindrical portion 57, in which a side where piston 52 moves for compression is flat, and tapered portion 58 on an opposite side of the side for compression (anti-compression side). This reduces sliding between piston 52 and cylinder bore 51, thereby decreasing the sliding loss.

However, in the above-described conventional constitution, in the case where tapered portion 58 is provided in cylinder bore 51 in order to decrease the sliding loss, there are problems below.

First, using the conventional examples in FIGS. 9 and 10, the bore distortion will be described. In the constitution shown in FIG. 9, the distortion due to the fastening of bolts 13 occurs in cylinder bore 8*b*.

Moreover, as for the constitution shown in FIG. 10, for the fastening of valve seat cover 12, valve plate 10 and the like to cylinder 21 using bolts 22 and nuts 23, portions corresponding to bolts 22 in cylinder 21 are largely removed for insertion of bolts 22. Thus, in the cylinder 21 portion, a portion where a thickness of a wall of cylinder bore 21*c* is thinner is formed, and in the portion of the thinner wall, the distortion due to the fastening of bolts 22 remains. Furthermore, back in a machining process, when cylinder bore 21*c* is machined, distortion due to stress and heat generated by a machining tool lowers machining accuracy of cylinder bore 21*c*, because the wall thickness is partially thinner. Moreover, because of the distortion due to the stress and the heat generated by the machining tool, it is difficult to make a clearance (gap) between cylinder bore 21*c* and piston 7 smaller.

Moreover, as described before, since the wall thickness of cylinder bore 21*c* is partially thinner, the distortion also occurs when bolts 22 are fastened, which makes it difficult to keep cylinder bore 21*c* in a highly accurate cylindrical shape.

Next, using the conventional example in FIG. 11, a reduction in sliding loss due to taper formation of cylinder bore 51 will be described.

In FIG. 11, cylindrical portion 57 is formed on the compression side of cylinder bore 51, and tapered portion 58 is formed on the anti-compression side to thereby reduce the sliding loss. In this case, however, unless a length of cylindrical portion 57 is made shorter, an expected effect of the sliding loss reduction cannot be obtained.

On the other hand, to make cylindrical portion 57 shorter is to make shorter a length of a portion where the clearance between piston 52 and cylindrical bore 51 is small, that is, a length of a sealed portion, which easily causes leakage of the gas such as the refrigerant. Moreover, retention in the gap of a lubricant (not shown) sealing the clearance portion, that is, the gap between cylinder bore 51 and piston 52 is deteriorated. As a result, an increase in compression loss due to the leakage of the gas (i.e., a decrease in compression efficiency), and a decrease in reliability due to shortage of the lubricant are brought about.

Here, in order to eliminate the reduction in sliding loss and the leakage of the gas, to make smaller the clearance between cylindrical portion 57 and piston 52 can be easily considered. However, as described in FIGS. 8, 9, and 10, in order to make the gap smaller, the distortion in machining needs to be reduced, and an influence by the distortion when the bolts 13 and 22 are tightened needs to be eliminated. Since the sliding portion (which denotes cylindrical portion 57) is short, when the distortion occurs, a contact pressure between piston 52 and cylinder bore 51 becomes higher, which brings about a decrease in reliability.

Accordingly, in the related art, there has been a problem that it is difficult to reduce the leakage of the gas from the gap between cylindrical portion 57 and piston 52, thereby maintaining the compression efficiency, and further assure the reliability while decreasing the sliding loss and enhancing the machine efficiency.

SUMMARY OF THE INVENTION

Consequently, the present invention provides a compressor including a hermetic container storing therein a lubricant, an electric element including a stator and a rotor, and a compression element driven by the electric element, the compression element including a crankshaft including a main shaft portion having the rotor fixed thereto, and an eccentric shaft portion, a bearing portion pivotally supporting the main shaft portion, a cylinder block made of a cylinder bore including a cylindrical portion and a tapered portion, a piston that reciprocates inside the cylinder bore, and a joining portion connecting the eccentric shaft portion and the piston, wherein a cylinder head is tightened and fixed together with a valve component by a bolt to an opening surface side of a compression chamber formed by the cylinder bore and the piston, and a screw hole portion formed in the opening surface side for fixing the bolt includes a counterbore extending to the vicinity of a boundary between the cylindrical portion and the tapered portion.

In the above-described compressor, distortion of the cylinder bore occurring when the bolt is tightened to the screw hole portion of the cylinder block reaches only the tapered portion in the vicinity of the screw hole portion without reaching the cylindrical portion. As a result, leakage of a gas from a gap between the cylindrical portion and the piston is reduced, which can eliminate an input increase due to an increase in friction resistance during reciprocation of the piston, thereby assuring higher efficiency and reliability.

DETAILED DESCRIPTION OF PREFERRED EMBODIMENT

Hereinafter, embodiments of the present invention will be described with reference to the drawings. The present invention is not limited by these embodiments.

First Embodiment

Figure 1:
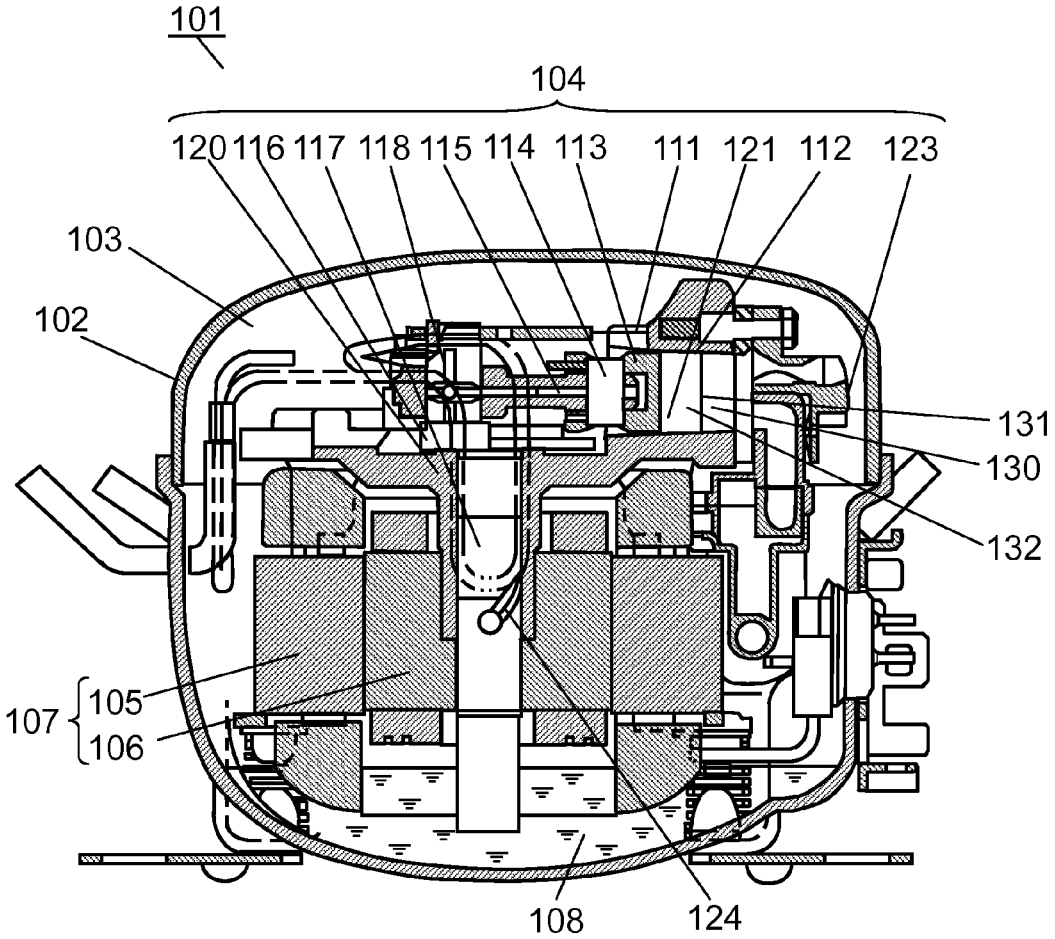
FIG. 1 shows a cross-sectional view of a compressor of a first embodiment of the present invention.
Figure 2:
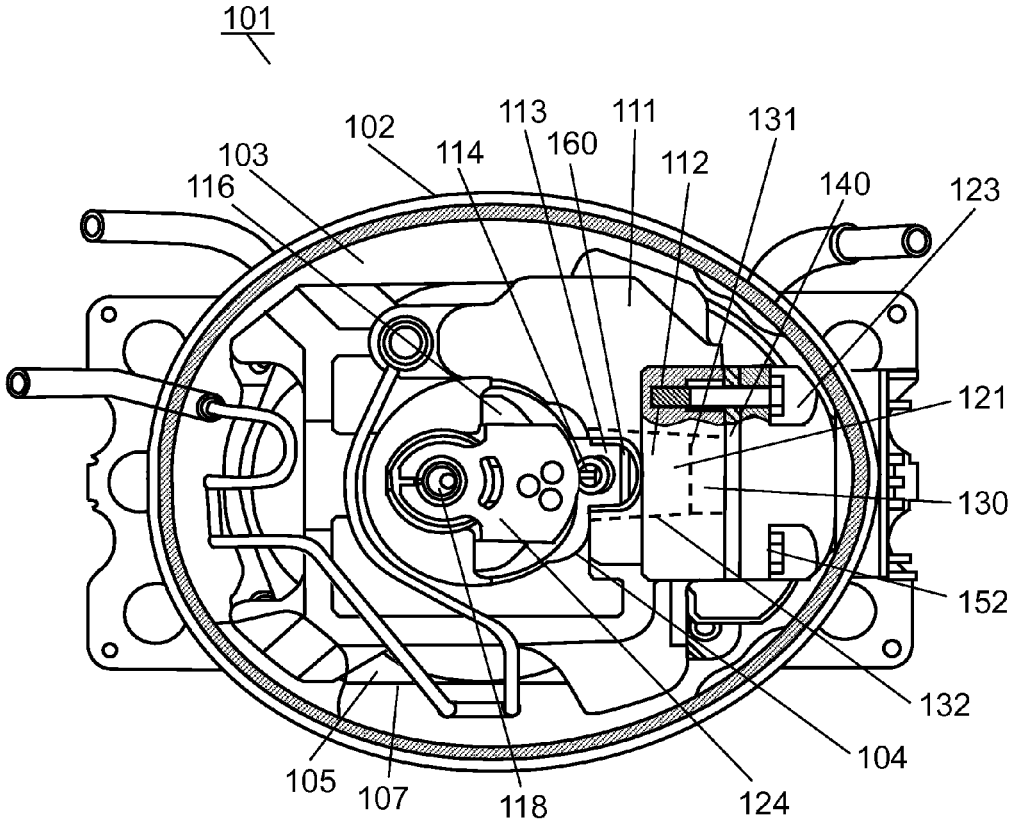
FIG. 2 shows a horizontal cross-sectional view of the same compressor.

FIG. 1 is a vertical cross-sectional view of a compressor of a first embodiment of the present invention, and FIG. 2 is a horizontal cross-sectional view of the same compressor. As shown in FIGS. 1 and 2, compressor 101 has refrigerant 103 enclosed inside hermetic container 102. As refrigerant 103, isobutane R600a, propane R290, R134a, R410A, R1234yf, carbon dioxide R744 and the like, which support recent ozone protection and prevention of global warming, can be cited. In the first embodiment, a description will be given, using R600a, and in the case where the individual refrigerant 103 has a specific effect, the name of the refrigerant 103 will be specified to give a description.

Inside hermetic container 102, compression element 104 and electric element 107 are contained. Furthermore, lubricant 108 is stored in a bottom portion of hermetic container 102. Here, electric element 107 includes stator 105 and rotor 106. Compression element 104 is driven by electric element 107.

Compression element 104 includes cylinder block 111, cylinder bore 112, piston 113, piston pin 114, joining portion 115, crankshaft 116, main shaft portion 117, eccentric shaft portion 118, bearing portion 120, compression chamber 121, cylinder head 123 and the like. Here, cylinder bore 112 is formed in cylinder block 111. Crankshaft 116 includes main shaft portion 117 having rotor 106 fixed thereto, and eccentric shaft portion 118. Bearing portion 120 pivotally supports main shaft portion 117. Piston 113 reciprocates inside cylinder bore 112. Compression chamber 121 is formed by cylinder bore 112 and piston 113. Cylinder head 123 partitions compression chamber 121 to form a suction and discharge portion. Joining portion 115 joins eccentric shaft portion 118 and piston 113.

Piston 113 and cylinder bore 112, main shaft portion 117 and bearing portion 120, eccentric shaft portion 118 and joining portion 115, and the like form sliding portions that slide to one another through lubricant 108. To the sliding portions, lubricant 108 in the bottom portion of hermetic container 102 is supplied by oil feeding mechanism 124 formed in crankshaft 116.

Lubricant 108 is a so-called refrigerant oil. As lubricant 108, a mineral oil, alkyl benzene, PAG (polyalkylene glycol), PAO (polyalphaolefin), ester, polycarbonate and the like are cited. Normally, lubricant 108 is not a little compatible with refrigerant 103. A dissolution ratio of refrigerant 103 to lubricant 108 varies, depending on a type of refrigerant 103, a type, a pressure and a temperature of lubricant 108, and a state/condition of a cooling system in operation or under suspension. It is, however, apparent that a state where refrigerant 103 is dissolved in lubricant 108 occurs.

For lubricant 108, a viscosity grade is decided with a kinetic viscosity at 40° C. used as a reference, and is expressed by a sign VG and a numerical value.

Figure 3:
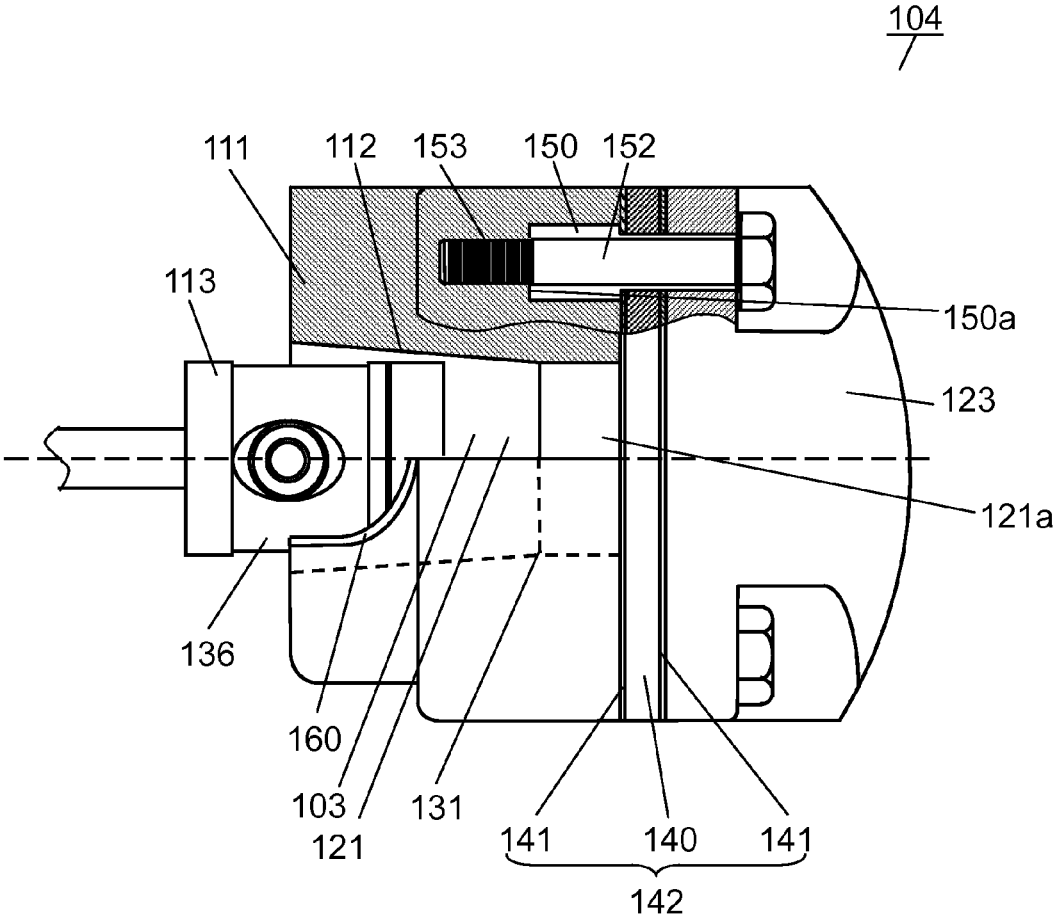
FIG. 3 shows a cross-sectional view of a substantial portion in the vicinity of a bottom dead point of a piston of the same compressor.
Figure 4:
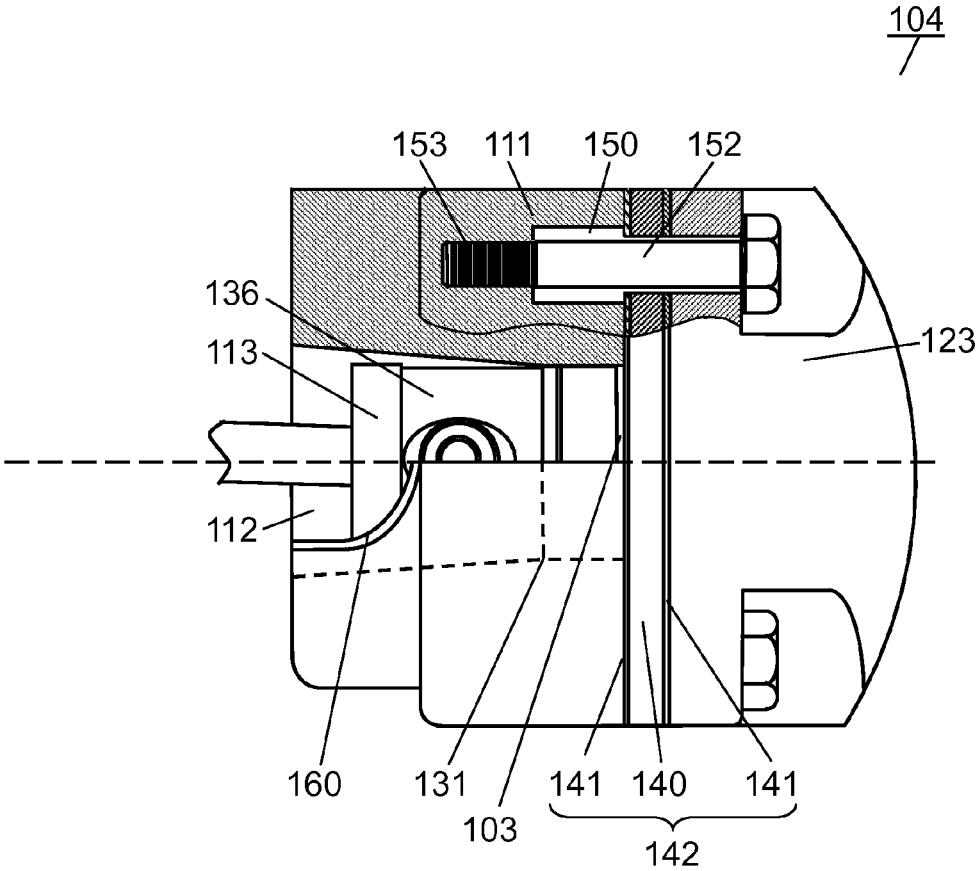
FIG. 4 shows a cross-sectional view of a substantial portion in the vicinity of a top dead point of the piston of the same compressor.

FIG. 3 is a cross-sectional view of a substantial portion in the vicinity of a piston bottom dead point of the compressor of the first embodiment of the present invention, and FIG. 4 is a cross-sectional view of a substantial portion in the vicinity of a piston top dead point of the same compressor. As shown in FIGS. 3 and 4, compression element 104 includes valve plate 140, gaskets 141, a discharge valve, a suction valve (neither of which is shown) and the like. Valve component 142 is made up of valve plate 140 and gaskets 141. Here, gaskets 141 seal leakage of a compressed gas such as refrigerant 103 between valve plate 140 and cylinder head 123, respectively. In valve plate 140, there are a suction hole and a discharge hole (neither of which is shown), which are flow paths for suction and discharge of the gas such as refrigerant 103, respectively, and opening and closing of the flow paths are performed by the discharge valve and the suction valve, respectively. Moreover, as shown in FIG. 3, cylinder head 123 and valve component 142 are fastened to screw hole portion 153 by bolt 152 on opening surface side 121*a* of compression chamber 121.

Figure 5:
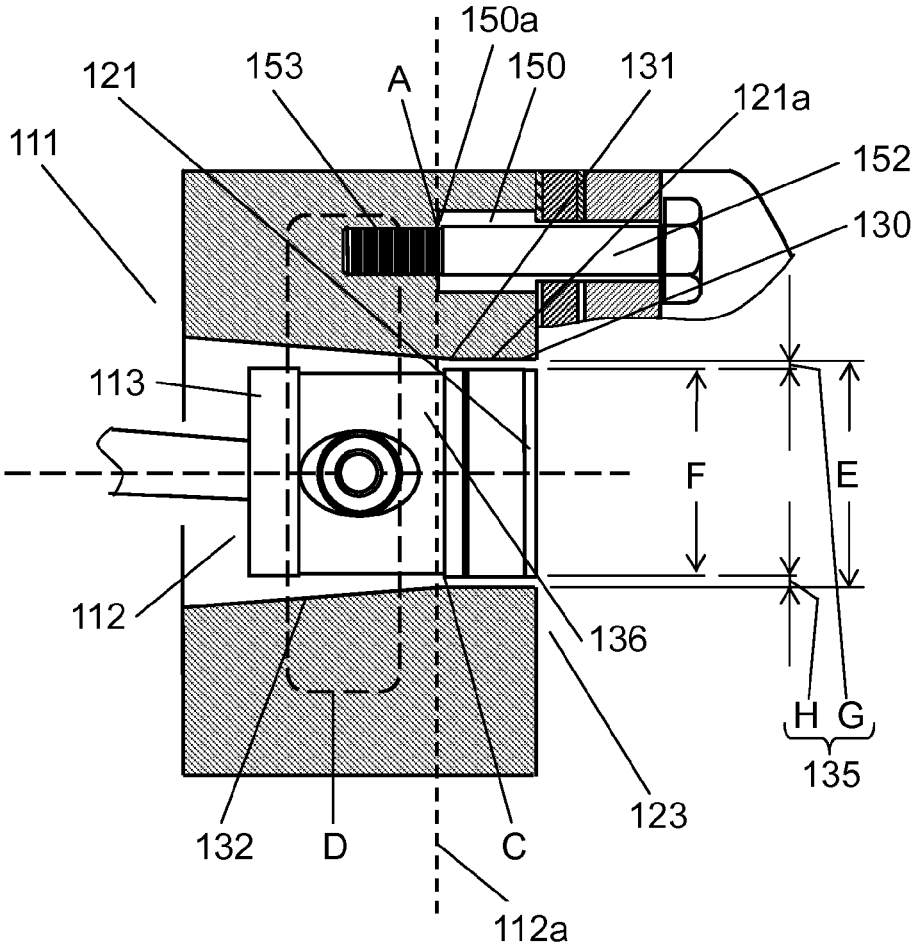
FIG. 5 shows a schematic cross-sectional view of the substantial portion in the top dead point of the piston of the same compressor.

Next, a constitution in which cylinder head 123 and valve component 142 are fastened to cylinder block 111 will be described. FIG. 5 is a schematic cross-sectional view of a substantial portion in the piston top dead point of the compressor of the first embodiment of the present invention. As shown in FIG. 5, cylinder bore 112 includes cylindrical portion 130 on a cylinder head 123 side, that is, on a compression side, and tapered portion 132 expanded in an opposite direction of the compression side with boundary 131 as a border. In cylinder block 111, screw hole portion 153 to fix bolt 152 is provided on opening surface side 121 a of compression chamber 121, and in screw hole portion 153, counterbore 150 extending to a vicinity of boundary 131 is formed. Deepest position A of counterbore 150 is provided in the vicinity of boundary 131. Cylinder head (123) further includes a third screw hole portion for accommodating bolt (152). The third screw hole portion has a diameter smaller than counterbore (150).

As shown in FIG. 5, diameter E of the bore is a diameter of the cylindrical portion of cylinder bore 112, and piston diameter F is a diameter of piston 113. A difference E-F between diameter E of the bore and diameter F of the piston is entire circumferential gap 135. Entire circumferential gap 135 is a sum of one-side gap G and opposite-side gap H. Moreover, in piston 113, groove 136 is formed.

In FIG. 5, sign C denotes a starting position of groove 136 formed in piston 113, and sign D denotes a region where distortion easily occurs in cylinder bore 112.

Groove 136 of piston 113 is formed so that a portion of groove 136 in piston 113 has a smaller diameter than diameter F of piston 113. The point where groove 136 starts on a cylindrical portion 130 side is piston groove starting position C.

As shown in FIG. 3, in a part of cylinder bore 112, cutout portion 160 is formed.

In the above-described constitution, an arrangement and an effect of counterbore 150 will be described in detail with reference to FIGS. 3, 4, and 5.

FIG. 3 shows a state where piston 113 is in the vicinity of the bottom dead point. From this state, piston 113 moves to a cylinder head 123 side to perform the compression of refrigerant 103. FIG. 4 shows a state where piston 113 compresses refrigerant 103 in a gas state, and piston 113 is located in the vicinity of the top dead point.

A temperature and a pressure of refrigerant 103 compressed up to the vicinity of the top dead point become high. Refrigerant 103 is discharged through valve component 142 and a discharge chamber (not shown) of cylinder head 123. Gaskets 141 are sandwiched between valve plate 140 of valve component 142 and cylinder head 123, and between valve plate 140 and cylinder block 111. Furthermore, gaskets 141 are tightened to cylinder block 111 by bolt 152 to be brought into pressure contact with the same, which prevents leakage of compressed refrigerant 103.

A tightening torque of bolt 152 varies, depending on a size and a purpose of compressor 101. For example, in the case where refrigerant 103 is isobutane, in compressor 101 for a refrigerator-freezer, bolt 152 is tightened at about 600 to 1200 Ncm. Thus, in cylinder block 111 which is a fastening portion of bolt 152, deformation due to the tightening occurs.

The deformation due to the tightening also brings about deformation in cylinder bore 112. In the constitution of the first embodiment, the distortion of cylinder bore 112 occurs in region D surrounded by dotted lines shown in FIG. 5. Region D is located in tapered portion 132 of cylinder bore 112. Thus, even if the distortion deformation occurs, the clearance (gap) between cylinder bore 112 and piston 113 expands, as compared with entire circumferential gap 135 in cylindrical portion 130. As a result, even if the deformation due to the distortion occurs, the deformation is caused at a position where entire circumferential gap 135 expands in tapered portion 132 from cylindrical portion 130. Thus, the sliding between piston 113 and cylinder bore 112 is not inhibited, and also, there is no local contact between piston 113 and cylinder bore 112, which will be a factor of a sliding loss. Accordingly, metal contact, which will be a factor of abrasion progress, is not caused, either.

Next, entire circumferential gap 135, which is the clearance between cylinder bore 112 and piston 113, will be described in detail.

In FIG. 5, entire circumferential gap 135 (E-F) is largely concerned with the leakage of refrigerant 103 during the compression. The smaller entire circumferential gap 135 is, the smaller a leakage amount of refrigerant 103 is, so that capability per unit cylinder capacity is increased, and a leakage loss becomes smaller. Particularly, since in the compressor used in a household refrigerator, a compression ratio is 10 or more, an influence of the loss due to the leakage is large, and it is desirable to make entire circumferential gap 135 smaller.

The present inventors have verified that in the constitution in which cylindrical portion 130 and tapered portion 132 are provided in cylinder bore 112, if entire circumferential gap 135 exceeds 10 μm, particularly large leakage of refrigerant 103 occurs. For example, if a cylindrical accuracy of piston 113 is 3 μm, a cylindrical accuracy on the machining of cylinder bore 112 is 3 μm, and entire circumferential gap 135 on design is 3 μm, the distortion needs to be 1 μm or less.

In the conventional constitution, as already described in Unexamined Japanese Patent Publication No. S56-12079, Unexamined Japanese Patent Publication No. S63-230975 and the like, a portion on the cylindrical portion 130 side of cylinder bore 112 is deformed. In consideration by the present inventors, a deformation amount in the portion on the cylindrical portion 130 side of cylinder bore 112 is 1 μm or more in spite of depending on the tightening torque of bolt 152.

This suggests that in the conventional constitution, in entire circumferential gap 135 of 10 μm or less, the distortion needs to be 1 μm or less in order to prevent the metal contact from occurring. Furthermore, in order to obtain smaller entire circumferential gap 135, machining accuracies of cylinder bore 112 and piston 113 need to be enhanced. Furthermore, the distortion needs to be 1 μm or less in order to assure entire circumferential gap 135 of 10 μm or less.

Moreover, if entire circumferential gap 135 is less than 3 μm, the clearance and sealing properties can be assured even in light of general mass-production machining. Further, if the cylindrical accuracies of piston 113 and cylinder bore 112 are 2 μm or less, respectively, and entire circumferential gap 135 on design is also 2 μm or less, entire circumferential gap 135 of 6 μm or less is also enabled. If with development of high-accuracy machining, the machining accuracies of piston 113 and cylinder bore 112 are 0.5 μm or less, respectively, and the clearance is 2 μm, setting of entire circumferential gap 135 can be 3 μm or more. As a result, since the leakage of refrigerant 103 from entire circumferential gap 135 becomes still smaller, the compressor with high volumetric efficiency and high compression efficiency will be provided. Accordingly, if entire circumferential gap 135 is 10 μm or less, and 3 μm or more, proper entire circumferential gap 135 in which both of the higher efficiency and enhancement in reliability can be obtained while considering a machining surface can be provided.

Next, the constitution and positional relationships of the components in the first embodiment, wherein entire circumferential gap 135 is 10 μm or less against the occurrence of the distortion, will be described.

As shown in FIG. 5, in cylinder bore 112, cylindrical portion 130 and tapered portion 132 are formed, as described before. A point where cylindrical portion 130 shifts to tapered portion 132 is boundary 131. On the other hand, a deepest position on a tapered portion 132 side of counterbore 150 is deepest position A of counterbore 150. In the first embodiment, this position is a starting point of screw hole portion 153, and is in the vicinity of boundary 131. In the first embodiment, bottom surface 150*a* (starting point A of screw hole portion 153) of counterbore 150 is located slightly on the tapered portion 132 side with respect to boundary 131.

Moreover, in the first embodiment, plane 112*a*, which passes bottom surface 150*a* of counterbore 150, and is perpendicular to cylinder bore 112, is located within a formation range of groove 136, and a position thereof is in the vicinity of starting position C of groove 136 of piston 113. That is, when a capacity of compression chamber 121 becomes smallest, starting position C of groove 136 is located in the vicinity of plane 112*a*, which passes bottom surface 150*a* of counterbore 150, and is perpendicular to cylinder bore 112. Thus, when in a final stage of the compression, piston 113 is located closer to the top dead point, in addition to the effect of distortion prevention of cylindrical portion 130 by counterbore 150, groove 136 of piston 113 allows influence by the distortion of cylindrical portion 130 extremely slightly remaining to be avoided. Since the distortion occurs in the portion the diameter of which expands in tapered portion 132, it does not affect cylindrical portion 130.

Moreover, even if the position of boundary 131 deviates in some degrees, reduction in clearance can be avoided by groove 136, which eliminates the distortion influence. Furthermore, since groove 136 has a function of retaining lubricant 108, the sealing properties can be also assured.

Moreover, retained lubricant 108 is supplied to piston 113 near the even clearance free from tightening distortion of bolt 152, and an entire circumference of the cylinder. As a result, both of the enhancement in sealing properties between piston 113 and cylinder bore 112, and the reduction in sliding loss can be achieved.

As described before, the tightening of bolt 152 brings about the deformation in screw hole portion 153, and the influence of the deformation reaches region D in FIG. 5. Since region D is located in tapered portion 132 of cylinder bore 112, even if the distortion occurs, the distortion will not occur in a range exceeding minimal entire circumferential gap 135 in cylindrical portion 130, and will not be directly-involved in the sliding of piston 113 in cylinder bore 112.

Accordingly, roundness of cylindrical portion 130 is not affected by the distortion, so that the deformation of cylindrical portion 130 is not caused even when bolt 152 is tightened. As a result, entire circumferential gap 135 between piston 113 and cylinder bore 112 in cylindrical portion 130 is made smaller, and the leakage loss is reduced by the enhancement in sealing properties, which allows the compressor with high volumetric efficiency to be provided.

Moreover, since the influence by the distortion does not hinder the assurance of the minimal entire circumferential gap 135, the metal contact between piston 113 and cylinder bore 112 does not occur, which allows the highly-reliable compressor in which abrasion hardly occurs to be provided. Furthermore, since the sliding portion is reduced, the sliding loss becomes smaller, which allows the efficient, highly-reliable compressor to be provided.

Furthermore, as shown in FIG. 3, in compressor 101 of the first embodiment, cutout portion 160 is provided in cylinder bore 112. An occurrence position of the distortion, thus, is in the vicinity of cutout portion 160 in region D shown in FIG. 5, which allows the distortion occurrence position in tapered portion 132 to be further controlled.

An effect of the formation position of groove 136 of piston 113 will be described in detail. Since a fore-end of piston 113 is sealed by lubricant 108, the leakage of refrigerant 103 is prevented. Here, the deformation of cylinder bore 112 due to the tightening of bolt 152 causes a decrease in sealing properties, thereby bringing about deterioration in performance and efficiency. In the first embodiment, however, as shown in FIG. 5, counterbore 150 reaching the vicinity of boundary 131 between cylindrical portion 130 and tapered portion 132 of cylinder bore 112 is provided. Further, the position where screw hole portion 153 starts from counterbore 150 is boundary 131 where tapered portion 132 starts (including the vicinity thereof). Groove 136 of piston 113 is located at boundary 131. This allows the distortion to be caused in the portion where the diameter of tapered portion 132 expands, and thus, the distortion does not affect cylindrical portion 130.

Moreover, even if the position of boundary 131 deviates in some degrees, reduction in clearance can be avoided by groove 136 of piston 113, which eliminates the distortion influence. Furthermore, since groove 136 has the function of retaining lubricant 108, the sealing properties can be also assured. Moreover, retained lubricant 108 is supplied to piston 113 near the even clearance free from tightening distortion of bolt 152, and the entire circumference of the cylinder to enhance the performance, efficiency and reliability.

Next, relationships between feeding and viscosity of lubricant 108 will be described.

In the first embodiment, refrigerant 103 is isobutane, and the viscosity grade of lubricant 108 is VG8 or lower.

The viscosity grade of lubricant 108 is related to the clearance between piston 113 and cylinder bore 112, that is, to entire circumferential gap 135. When the viscosity grade is VG8 or lower, a temperature of lubricant 108 in the compression portion is in the vicinity of 120° C., and thus, the viscosity becomes $3\times10^{-6}$ $m^2/s$ or lower, which decreases an abrasion resisting force of lubricant 108. As a result, even slight metal contact leads to an increase in abrasion.

Moreover, a decrease in viscosity of lubricant 108 causes a decrease in sealing properties between piston 113 and cylinder bore 112. The present inventors have found that if the viscosity of lubricant 108 is $3\times10^{-6}$ $m^2/s$ or lower, the retention of lubricant 108 in entire circumferential gap 135 cannot be sufficiently assured, unless entire circumferential gap 135 is 10 μm or less. Accordingly, if lubricant 108 cannot be retained, the leakage of refrigerant 103 from entire circumferential gap 135 rapidly increases, thereby decreasing the volumetric efficiency.

Particularly in the household refrigerator or refrigerator-freezer, when refrigerant 103 is isobutane, freezing capability per unit cylinder capacity is lower. Thus, when refrigerant 103 is isobutane, an almost double cylinder capacity is required, as compared with HFC 134a. Accordingly, bore diameter E of cylinder bore 112 needs to be further increased. Moreover, in order to keep entire compressor 101 small even though cylinder bore 112 is made larger, an outer wall of cylinder bore 112 of cylinder block 111 is made thinner.

As described above, compressor 101 of the first embodiment can increase the capability per unit cylinder capacity (volumetric efficiency), and achieve downsizing and higher capability, while performing resource saving by downsizing and reducing materials. Moreover, the reduction in length of the sliding portion between piston 113 and cylinder bore 112, and the reduction in viscous property loss due to the decrease in viscosity of lubricant 108 will bring about the reduction in sliding loss.

Furthermore, counterbore 150 is located in the vicinity of boundary 131. Groove 136 of piston 113 in the vicinity of the top dead point is located in the vicinity of counterbore 150. This reduces the distortion of cylindrical portion 130, so that the problem when lubricant 108 of VG8 or lower is used is solved, and the efficiency of compressor 101 is maximized.

Next, a case where refrigerant 103 is propane or carbon dioxide, which is a high-pressure refrigerant, will be described.

In the first embodiment, it is a necessary premise that refrigerant 103 has a low load particularly to environment, that is, has a small ozone destruction coefficient. Moreover, a technological thought is based on a premise that an environmental load is small. From these view points, either of propane and carbon dioxide is refrigerant 103 having a low load to environment, and can be applied to the use of refrigerating and freezing. However, a problem of propane and carbon dioxide as refrigerant 103 is that a high pressure that is a pressure compressed up to the vicinity of the top dead point is higher.

If the high pressure is high, the distortion during compression by the high pressure also causes deformation in cylinder bore 112 in a condition where a load on compressor 101 is high. If the high pressure is high, the leakage occurs, unless cylinder head 123 and valve component 142 are made to stick together with a higher force. It is, thus, important to avoid the distortion deformation of cylindrical portion 130 of cylinder bore 112 when they are tightened with a stronger force.

As for the leakage, in a higher-pressure refrigerant, it is important to assure the sealing properties between piston 113 and cylindrical portion 130 of cylinder bore 112. This can be easily realized by making entire circumferential gap 135 smaller. For this as well, the constitution of the first embodiment that can make the distortion of cylindrical portion 130 smaller is effective. Therefore, in regard to the specific problem to the high-pressure refrigerant 103 such as propane and carbon dioxide, the loss reduction and enhancement in volumetric efficiency can be achieved.

Next, actions and effects in the first embodiment at the time of machining will be described.

As shown in FIG. 1, compressor 101 of the first embodiment has bearing portion 120 pivotally supporting main shaft portion 117, and cylinder block 111 made of cylinder bore 112 including cylindrical portion 130 formed into a cylindrical shape, and tapered portion 132. With this, in a machining stage of cylinder bore 112, cylinder block 111 is fixed with a jig and the like to machine cylinder bore 112. The machining includes boring by a drill or the like and finishing honing to cylinder bore 112.

In either process, unless a periphery of cylinder bore 112 has a certain level of rigidity, the deformation will occur in cylinder bore 112 during machining. Particularly, in the constitution of Unexamined Japanese Patent Publication No. S56-12079 or the like, even if the deformation of cylinder bore 112 when the bolt is tightened can be avoided, a bolt tightening space is required around cylinder bore 112. This decreases the rigidity around cylinder bore 112, thereby causing deformation to remain in cylinder bore 112, particularly in cylindrical portion 130 by machining pressure of the drill and a honing tool during machining.

According to the first embodiment of the present invention, since only counterbore 150 is provided in the periphery of cylinder bore 112, enough rigidity to endure the pressure during machining is assured. Even when cylinder head 123 and valve component 142 are tightened and fixed to screw hole portion 153 of cylinder block 111 by bolt 152, the deformation of cylindrical portion 130 is largely reduced. As a result, an accuracy when cylindrical portion 130 is assembled is enhanced, so that both of the assurance of the efficiency and the assurance of the reliability of compressor 101 can be achieved.

Moreover, in the first embodiment, the viscosity of lubricant 108 is VG8 or lower, and VG3 or higher. The reduction in viscosity of lubricant 108 decreases a viscous friction loss, and contributes to efficiency enhancement. However, when the distortion due to the tightening of bolt 152 occurs in cylindrical portion 130, the abrasion resisting force of lubricant 108 with the viscosity of VG8 or lower is low. This makes efficiency enhancement by the reduction in sliding loss difficult.

However, even though the viscosity of lubricant 108 is VG8 or lower, the metal contact hardly occurs and the sealing properties are favorite, which allows lubricant 108 to be stably maintained inside the clearance. As a result, the use of lubricant 108 with the viscosity of VG8 or lower brings about the sliding loss reduction. Furthermore, lubricant 108 with the low viscosity makes the sealing properties stable, thereby reducing the leakage. Accordingly, an increase in efficiency by the higher compression efficiency and the sliding loss reduction is enabled while increasing the reliability.

Moreover, for refrigerant 103, isobutane, propane or carbon dioxide can be used. Propane and carbon dioxide are each a refrigerant having high capability per unit cylinder capacity and a high discharge pressure.

In compressor 101 using above-described refrigerant 103, the cylinder capacity is small, and the capability per unit cylinder capacity is large. Thus, an influence degree on the volumetric efficiency of compressor 101 by a small amount of leakage of refrigerant 103 is large, and an influence on the freezing capability is large. At the same time, this leakage will be also a factor destroying the retention of lubricant 108 between piston 113 and cylinder bore 112, thereby promoting abrasion.

In the conventional compressor, in order to reduce the distortion of cylinder bore 112, an outer wall of cylinder bore 112 in a portion to which bolt 152 is fastened needs to be shaved. Thus, with high-pressure refrigerant 103 such as propane and carbon dioxide, it is difficult to strike a balance between the rigidity of cylinder block 111 and the distortion during compression of cylinder bore 112. According to the present invention, however, since the occurrence of the distortion of cylinder bore 112 can be suppressed and a thickness of cylinder bore 112 can be assured, the rigidity can be kept higher.

While in the first embodiment, the reciprocating compressor in a connecting-rod/piston method has been described, the present invention can also be applied to a positive-displacement-type rotary compressor, or a compressor of another compression type such as a turbo type.

Moreover, while the refrigerant is not limited, the present invention is particularly effective in the case where a natural refrigerant having a low load to environment is used, as described above.

Second Embodiment

Figure 6:
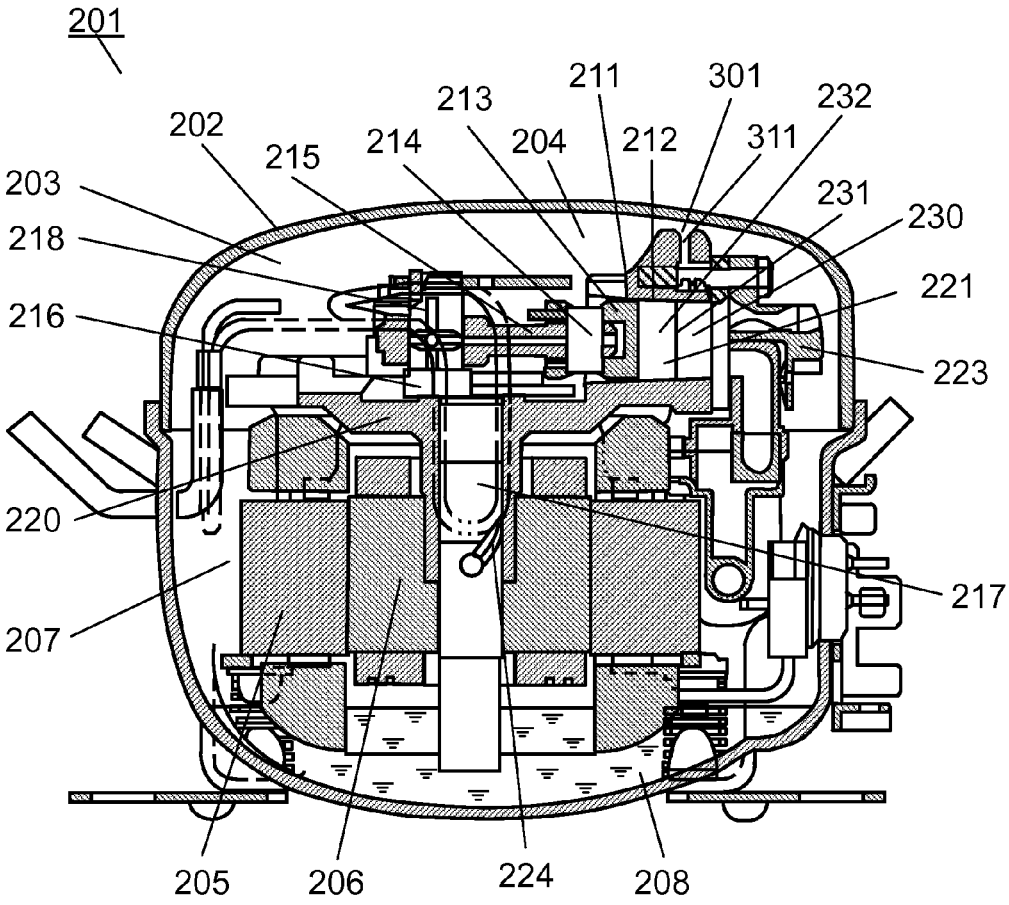
FIG. 6 shows a vertical cross-sectional view of a compressor of a second embodiment of the present invention.
Figure 7:
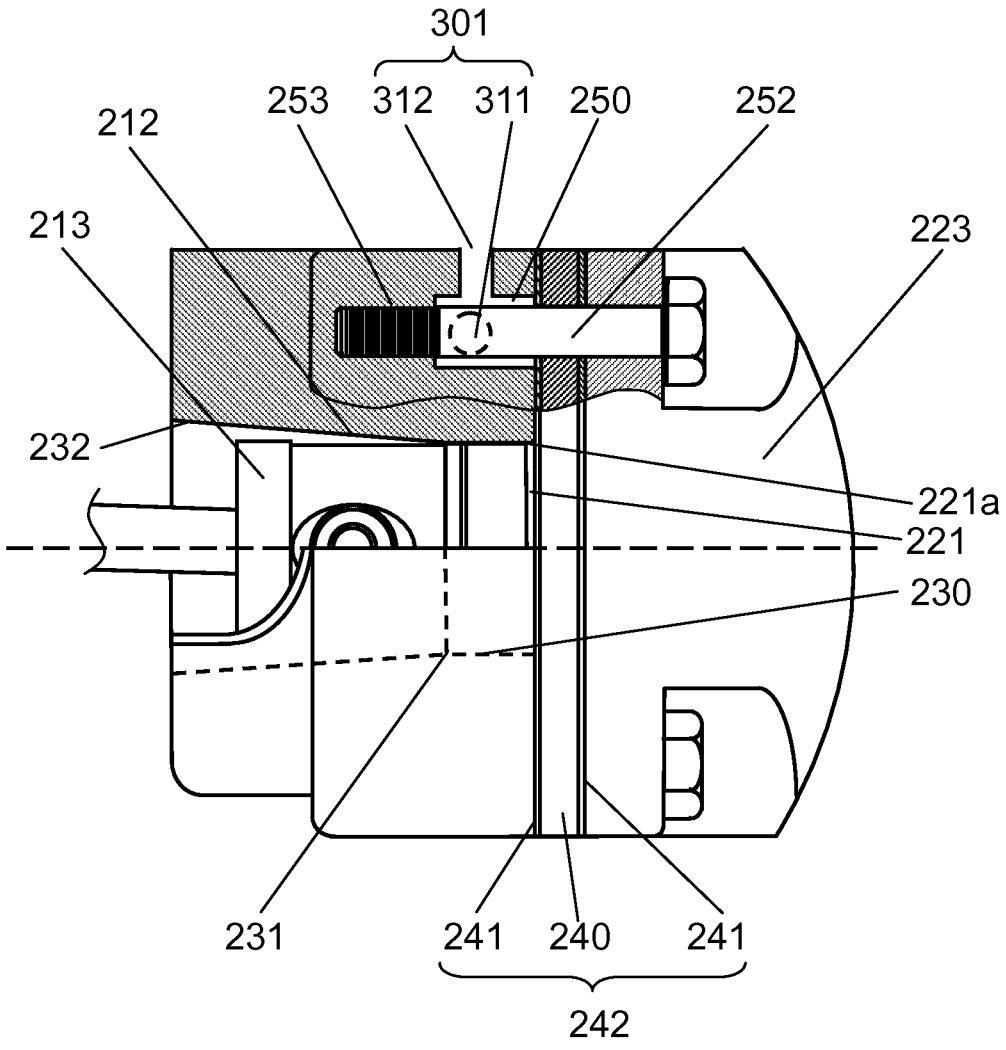
FIG. 7 shows a cross-sectional view of a substantial portion in the vicinity of a top dead point of a piston of the same compressor.
Figure 8:
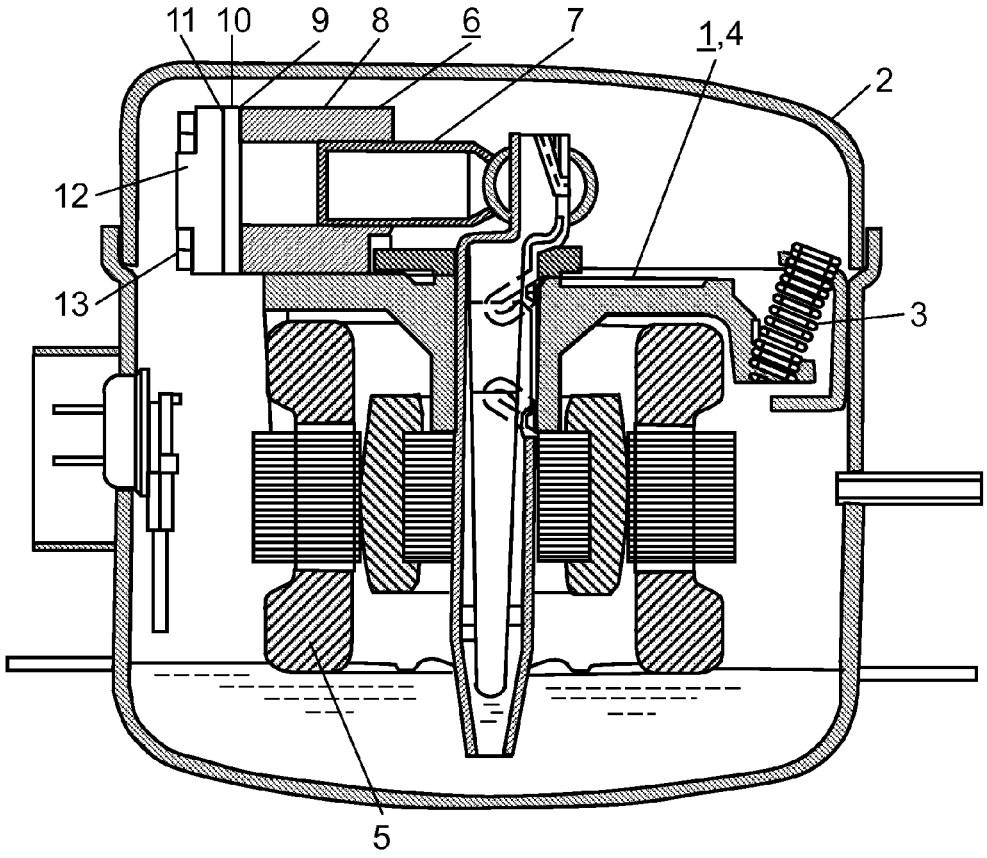
FIG. 8 PRIOR ART
FIG. 8 shows a vertical cross-sectional view of a conventional compressor.
Figure 9:
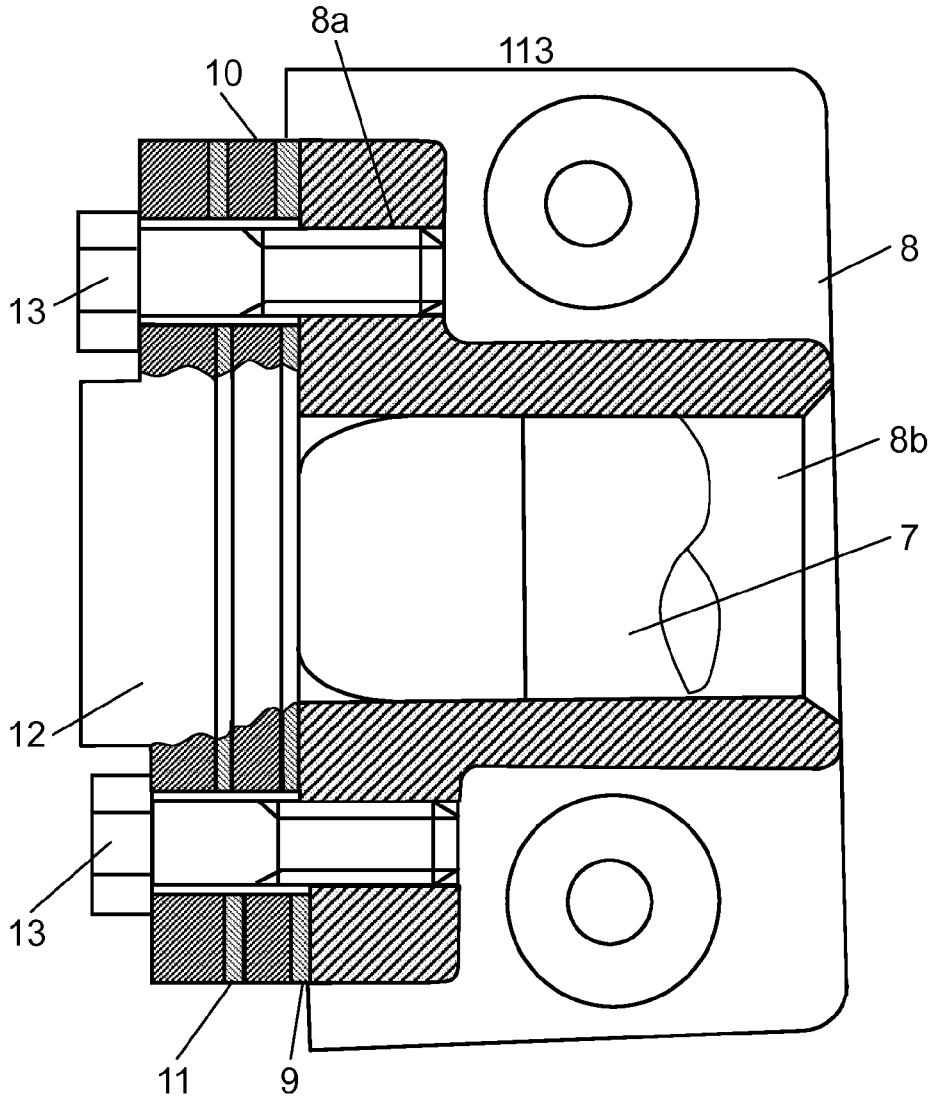
FIG. 9 PRIOR ART
FIG. 9 shows a plan view of a substantial portion in which a part of the same compressor is cut out.
Figure 10:
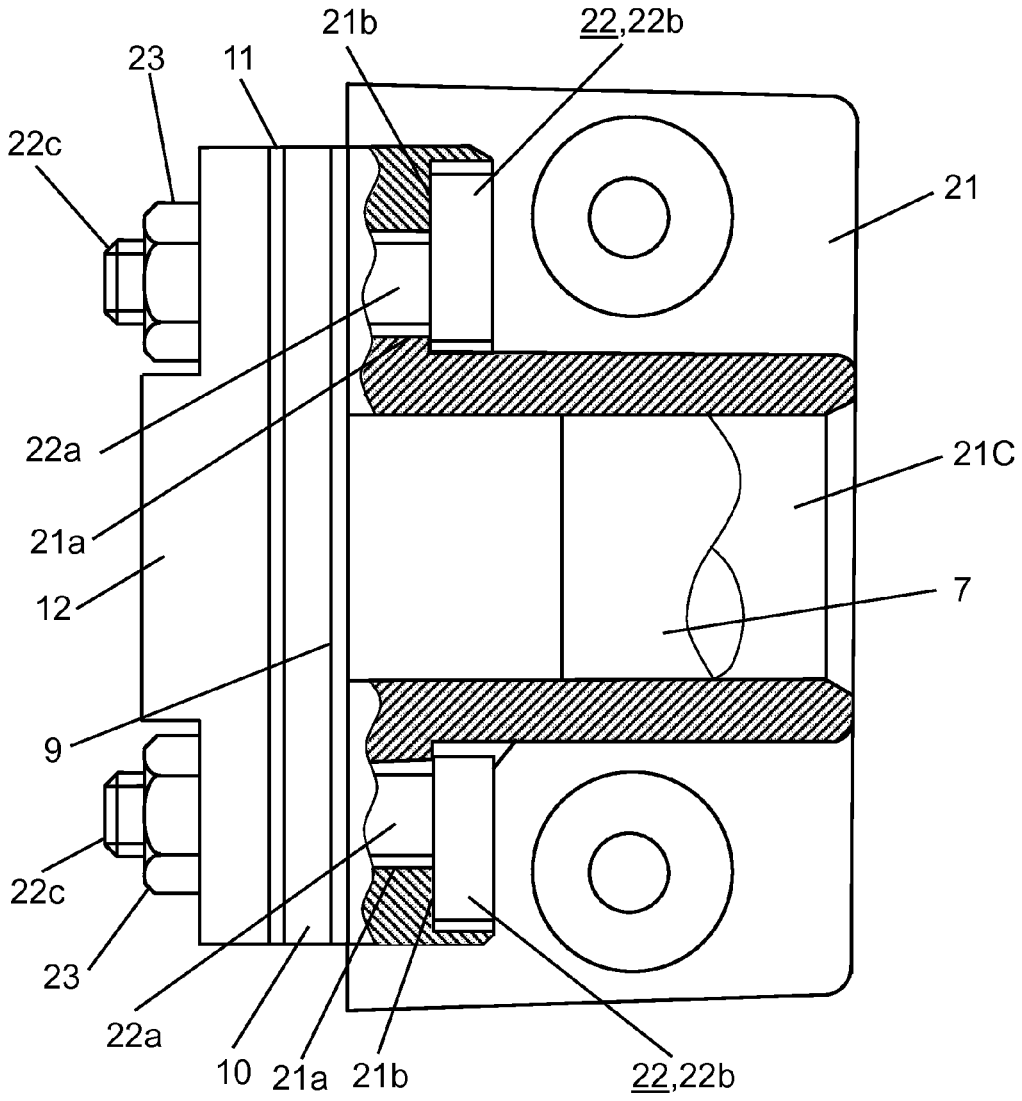
FIG. 10 PRIOR ART
FIG. 10 shows a plan view of a substantial portion in which a part of another conventional compressor is cut out.
Figure 11:
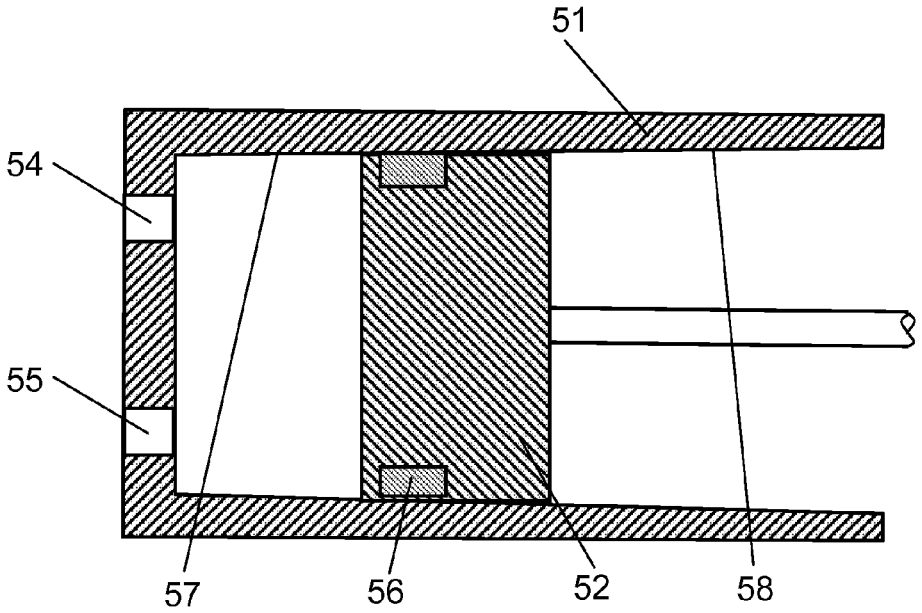
FIG. 11 PRIOR ART
FIG. 11 shows a cross-sectional view of a substantial portion of still another conventional compressor.

FIG. 6 is a vertical cross-sectional view of a compressor of a second embodiment of the present invention, and FIG. 7 is a cross-sectional view of a substantial portion in the vicinity of a piston top dead point of the same compressor.

In the second embodiment of the present invention, the same names will be given to the same components as those in the first embodiment, and detailed descriptions thereof will be omitted.

In FIGS. 6 and 7, compressor 201 has refrigerant 203 enclosed inside hermetic container 202. For refrigerant 203 and lubricant 208, the same materials exemplified for refrigerant 103 and lubricant 108 in the first embodiment are used. Constitutions of compression element 204 and electric element 207 are the same as those of compression element 104 and electric element 107 in the first embodiment.

Next, details of compression element 204 will be described mainly with reference to FIG. 7.

In cylinder bore 212, cylindrical portion 230 is formed on a cylinder head 223 side, that is, on a cylindrical portion 230 side, and tapered portion 232 that expands in an opposite direction of the cylindrical portion 230 side with boundary 231 as a border. A diameter of the bore is a diameter of the cylindrical portion of cylinder bore 212. A piston diameter is a diameter of piston 213. A difference between the diameter of cylinder bore 212 and the diameter of piston 213 is an entire circumferential gap.

Compression element 204 includes valve plate 240, gaskets 241, a discharge valve, a suction valve (neither of which is shown) and the like. Here, gaskets 241 seal leakage of a compressed gas such as refrigerant 203 between valve plate 240 and cylinder head 223. Valve plate 240, gaskets 241, the discharge valve, and the suction valve are collectively referred to as valve component 242. Valve plate 240 is provided with a suction hole and a discharge hole (neither of which is shown), which are flow paths of suction and discharge of the gas such as refrigerant 203, respectively. Opening and closing of the flow paths are performed by the discharge valve and the suction valve, respectively.

Next, a constitution in which cylinder head 223 and valve component 242 are fastened to cylinder block 211 will be described. In cylinder block 211, counterbore 250 is formed on opening surface side 221*a* of compression chamber 221. Screw hole portion 253 to fasten bolt 252 is formed so as to joint to counterbore 250. A deepest position of counterbore 250 is provided in the vicinity of boundary 231 between cylindrical portion 230 and tapered portion 232 of cylinder bore 212. Cylinder head 223 and valve component 242 are fastened to screw hole portion 253 by bolt 252.

Counterbore 250 of cylinder block 211 is provided with through hole 301 that communicates with the interior of hermetic container 202. Through hole 301 has through hole inlet 311 and through hole outlet 312 for discharging lubricant 208. Through hole inlet 311 and through hole outlet 312 communicate with counterbore 250, respectively, and are opened at different positions.

Hereinafter, referring to FIGS. 6 and 7, operation and actions of the compressor of the second embodiment of the present invention will be described.

First, generated heat during compression and cooling of the cylinder bore 212 portion will be described. In the case where refrigerant 203 is a compressed gas, particularly rise in temperature by the compression is large. A temperature of refrigerant 203 often exceeds 150° C., in spite of differing depending on the refrigerant 203 and compression conditions. As a result, a local rise in temperature of cylindrical portion 230 of cylinder bore 212, a rise in temperature of a discharge chamber (not shown) of cylinder head 223, and a local rise in temperature occurring in cylinder head 223 are caused.

The above-described local rises in temperature directly cause thermal distortion of cylindrical portion 230, and increase a stress applied to bolt 252 tightening cylinder head 223, thereby causing the thermal distortion of cylindrical portion 230. In order to reduce the thermal distortion, a vicinity of cylindrical portion 230 is cooled, cylinder head 223 is indirectly cooled through bolt 252, or bolt 252 itself is cooled.

In the constitution described in the second embodiment, through the through hole 301 provided in counterbore 250, counterbore 250 and refrigerant 203 inside hermetic container 202 are communicated with each other. As a result, refrigerant 203 performs cooling of a space of counterbore 250. This can suppress deformation due to the thermal distortion, and can keep roundness of cylindrical portion 230 higher.

Furthermore, when through hole 301 is provided in counterbore 250, the temperature of the compressed gas used as refrigerant 203 is decreased. As a result, the volumetric efficiency of compressor 201 is enhanced, and production of organic products attributed to the high temperature is reduced. Moreover, deterioration of lubricant 208 is suppressed, and efficiency enhancement and reliability enhancement of compressor 201 are achieved. Furthermore, since a rise in temperature of cylindrical portion 230, particularly, in a final stage of the compression is suppressed, deformation due to thermal distortion is also suppressed, and the roundness of cylindrical portion 230 is kept still higher.

Moreover, through hole 301 has through hole inlet 311 and through hole outlet 312. This allows lubricant 208 to be ejected from through hole outlet 312, even when lubricant 208 comes into counterbore 250 from through hole inlet 311. Lubricant 208 brings about a larger cooling effect than the cooling effect by foregoing refrigerant 203.

Furthermore, an oil feeding constitution for obtaining the cooling effect by lubricant 208 will be described.

Lubricant 208 is stored in a bottom portion of hermetic container 202. Lubricant 208 is fed to respective sliding portions by oil feeding mechanism 224 formed in crankshaft 216, and squirts from an upper end of eccentric shaft portion 218 to fall on through hole inlet 311. Falling lubricant 208 is also continuously fed to counterbore 250, and is continuously ejected from through hole outlet 312. Thereby, the inside of counterbore 250 can be cooled, and the foregoing cooling of cylindrical portion 230 of cylinder bore 212 and the like is enabled.

In order to obtain the above-described cooling effect, in the case where isobutane is used as refrigerant 203, the freezing capability per unit cylinder capacity is relatively small, and thus, the cylinder capacity of compressor 201 needs to be relatively large.

On the other hand, downsizing of compressor 201 will lead to resource saving. Thus, it is necessary to make entire cylinder block 211 smaller while making the diameter of cylinder bore 212 larger. As a result, a thickness of an outer wall of cylinder bore 212 becomes smaller. Moreover, since the capability per unit cylinder capacity is small, a decrease in volumetric efficiency due to the leakage influence and the like when the diameter of cylinder bore 212 is made larger, and eventually, a decrease in efficiency as compressor 201 will notably appear.

In the conventional compressor, in order to reduce the distortion of cylinder bore 212, the outer wall of cylinder bore 212 in a portion to which bolt 252 is fastened needs to be shaved. This will increase the machining distortion. However, according to the constitution of the second embodiment, even when the diameter of cylinder bore 212 is made larger, thereby making the thickness of the outer wall of cylinder bore 212 smaller, a size of entire cylinder block 211, and eventually, a size of entire compressor 201 can be made smaller.

Moreover, the outer wall of cylinder bore 212 can have a sufficient thickness. Furthermore, counterbore 250 prevents the distortion of cylinder bore 212 accompanying the tightening of bolt 252 from reaching cylindrical portion 230. Moreover, a situation where an outer diameter of piston 213, that is, an inner diameter of cylinder bore 212 becomes larger, and a sliding area between piston 213 and cylinder bore 212 becomes larger is addressed as follows. That is, the sliding is performed only in the cylindrical portion 230, and the distortion of cylindrical portion 230 is eliminated, and further, the clearance can be made smaller, as described in the first embodiment.

Provision of through hole inlet 311 and through hole outlet 312 making up through hole 301 in counterbore 250 brings about the cooling effect by the gas such as refrigerant 203 and lubricant 208. This can enhance the volumetric efficiency by the cooling, and suppress the distortion of cylindrical portion 230 of cylinder bore 212. Accordingly, while using refrigerant 203 having a small environmental load, the efficiency can be maximized. Thus, as refrigerant 203, isobutane can be used.

In the conventional compressor, in order to reduce the distortion of cylinder bore 212, the outer wall of cylinder bore 212 in the portion to which bolt 252 is fastened is shaved. In such machining, it is difficult to strike a balance between the maintenance of the rigidity of cylinder block 211 and response to the distortion of cylinder bore 212 during compression, in the case where high-pressure refrigerant 203 such as propane and carbon dioxide is used.

However, according to the constitution of the second embodiment, since the occurrence of the distortion of cylinder bore 212 is suppressed, and the thickness of cylinder bore 212 itself is assured, the rigidity can be kept higher. Furthermore, the constitution of through hole 301 provided in counterbore 250 brings about the cooling effect by the gas such as refrigerant 203, and the lubricant 208. This can further enhance the volumetric efficiency by the cooling, and suppress the distortion of cylindrical portion 230 of cylinder bore 212. Accordingly, the efficiency and reliability can be assured, even when for refrigerant 203, propane or carbon dioxide, which has a small environmental load and a high pressure, is used.

What is claimed is:

1. A compressor comprising:
a hermetic container storing therein
a lubricant,
an electric element including a stator and a rotor, and
a compression element driven by the electric element,
the compression element including
a crankshaft including a main shaft portion having the rotor fixed thereto, and an eccentric shaft portion,
a bearing portion pivotally supporting the main shaft portion,
a cylinder block having a cylinder bore formed therein, the cylinder bore including a cylindrical portion and a tapered portion,
a piston that reciprocates inside the cylinder bore,
a joining portion connecting the eccentric shaft portion and the piston, and
a screw hole section,
wherein
a cylinder head is coupled to the cylinder block by a bolt which extends through the screw hole section which penetrates the cylinder block and the cylinder head,
wherein the screw hole section includes:
a first screw hole section having a first diameter which engages threads of the bolt;
a second screw hole section having a second diameter which is larger than the first diameter and a diameter of the bolt in the second screw hole section; and
a third screw hole section having a third diameter smaller than the second diameter,
wherein the second screw hole section having the second diameter is disposed between the first screw hole section having the first diameter and the third screw hole section having the third diameter, and
wherein a boundary between the first screw hole section and the second screw hole section is substantially at a boundary between the cylindrical portion and the tapered portion.

2. The compressor according to claim 1, wherein
an entire circumferential gap, which is a difference between a diameter of the cylindrical portion and a diameter of the piston, is from 3 μm to 10 μm.

3. The compressor according to claim 1, wherein
the piston is provided with a groove, and a starting position of the groove is located at a plane extending from a bottom surface of the counterbore and perpendicular to the cylinder bore, when a capacity of the compression chamber becomes smallest.

4. The compressor according to claim 1, wherein
a viscosity of the lubricant is from ISO VG3 to ISO VG8.

5. The compressor according to claim 1, wherein
the counterbore has a through hole communicating with the interior of the hermetic container.

6. The compressor according to claim 5, wherein
the crankshaft is provided with an oil feeding mechanism for feeding oil to sliding portions, and the through hole has a through hole inlet for taking the lubricant, and a through hole outlet for discharging the lubricant.

7. A compressor comprising:
a hermetic container storing therein
a lubricant,
an electric element including a stator and a rotor, and
a compression element driven by the electric element,
the compression element including
a crankshaft including a main shaft portion having the rotor fixed thereto, and an eccentric shaft portion,
a bearing portion pivotally supporting the main shaft portion,
a cylinder block having a cylinder bore formed therein, the cylinder bore including a cylindrical portion and a tapered portion,
a piston that reciprocates inside the cylinder bore, and a joining portion connecting the eccentric shaft portion and the piston, wherein a cylinder head is tightened and fixed together with a valve component by a bolt to an opening surface side of a compression chamber formed by the cylinder bore and the piston, and a screw hole section is formed in the opening surface side for fixing the bolt, wherein the screw hole section includes:

a first screw hole section having a first diameter which engages threads of the bolt; and a second screw hole section having a second diameter which is larger than the first diameter and a diameter of the bolt in the second screw hole section, wherein a boundary between the first screw hole section and the second screw hole section is substantially at a boundary between the cylindrical portion and the tapered portion, and wherein the cylinder block further has a cutout portion that allows an occurrence position of a distortion caused by tightening and fixing by the bolt in the tapered portion to be controlled.

8. The compressor according to claim 7, wherein an entire circumferential gap, which is a difference between a diameter of the cylindrical portion and a diameter of the piston, is from 3 mm to 10 mm.

9. The compressor according to claim 7, wherein the piston is provided with a groove, and a starting position of the groove is located at a plane extending from a bottom surface of the counterbore and perpendicular to the cylinder bore, when a capacity of the compression chamber becomes smallest.

10. The compressor according to claim 7, wherein a viscosity of the lubricant is from ISO VG3 to ISO VG8.

11. The compressor according to claim 7, wherein the counterbore has a through hole communicating with the interior of the hermetic container.

12. The compressor according to claim 11, wherein the crankshaft is provided with an oil feeding mechanism for feeding oil to sliding portions, and the through hole has a through hole inlet for taking the lubricant, and a through hole outlet for discharging the lubricant.

13. A compressor comprising:

a hermetic container storing therein a lubricant, an electric element including a stator and a rotor, and a compression element driven by the electric element, the compression element including a crankshaft including a main shaft portion having the rotor fixed thereto, and an eccentric shaft portion, a bearing portion pivotally supporting the main shaft portion, a cylinder block having a cylinder bore formed therein, the cylinder bore including a cylindrical portion and a tapered portion, a piston that reciprocates inside the cylinder bore, and a joining portion connecting the eccentric shaft portion and the piston, wherein a cylinder head is tightened and fixed together with a valve component by a bolt to an opening surface side of a compression chamber formed by the cylinder bore and the piston, a screw hole section is formed in the opening surface side of the compression chamber of the cylinder block for fixing the bolt, wherein the screw hole section includes:

a first screw hole section having a first diameter which engages threads of the bolt; and a second screw hole section having a second diameter which is larger than the first diameter and a diameter of the bolt in the second screw hole section, wherein a boundary between the first screw hole section and the second screw hole section is substantially at a boundary between the cylindrical portion and the tapered portion, and an amount of distortion caused by tightening and fixing by the bolt in the cylinder bore is smaller than an amount of an expansion of the tapered portion compared with the cylindrical portion.

* * * * *